US007108120B2

(12) United States Patent
Furuya

(10) Patent No.: US 7,108,120 B2
(45) Date of Patent: Sep. 19, 2006

(54) COIN INSPECTION METHOD AND APPARATUS THEREFOR

(75) Inventor: Yonezo Furuya, Hatoyama-machi (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/528,282

(22) Filed: Mar. 17, 2000

(65) Prior Publication Data

US 2003/0102197 A1 Jun. 5, 2003

(30) Foreign Application Priority Data

Mar. 17, 1999 (JP) ..... 11-071980

(51) Int. Cl.
*G07D 5/08* (2006.01)

(52) U.S. Cl. ..... 194/318; 194/317; 194/320; 194/328

(58) Field of Classification Search ..... 194/317–320, 194/328, 330; 702/38
See application file for complete search history.

(56) References Cited

U.S. PATENT DOCUMENTS 3,870,137 A 3/1975 Fougere
4,754,862 A * 7/1988 Rawicz-Szczerbo et al. ..... 194/317
5,158,166 A * 10/1992 Barson ..... 194/319
5,180,046 A * 1/1993 Hutton et al. ..... 194/319
5,458,225 A * 10/1995 Iwamoto et al. ..... 194/318
5,630,494 A * 5/1997 Strauts ..... 194/317
5,982,918 A * 11/1999 Mennie et al. ..... 382/135
5,988,348 A * 11/1999 Martin et al. ..... 194/317
6,101,266 A * 8/2000 Laskowski et al. ..... 382/135
6,196,371 B1 * 3/2001 Martin et al. ..... 194/317
6,259,316 B1 * 7/2001 Nagaraj ..... 330/9
6,288,538 B1 * 9/2001 Aruga et al. ..... 194/320
6,325,197 B1 * 12/2001 Furuya ..... 194/318

FOREIGN PATENT DOCUMENTS

JP S58-6190 B 2/1983
JP 59-168589 9/1984
JP S63-57835 B 11/1988

(Continued)

OTHER PUBLICATIONS

Abstract of JP 59-168589.*

*Primary Examiner*—Kathy Matecki
*Assistant Examiner*—Jeffrey A. Shapiro
(74) *Attorney, Agent, or Firm*—Koda & Androlia

(57) ABSTRACT

A coin inspection method and apparatus capable of inspecting coins having different materials and surface patterns with high accuracy by a simple coil arrangement. An exciting coil is arranged in the vicinity of one side of a coin passage inclined at a predetermined angle so that two magnetic poles thereof face the coin passage. Two receiving coils having substantially identical characteristics are arranged in the vicinity of the same side of the coin passage so that the receiving coils are electromagnetically coupled with the exciting coil. The exciting coil is excited at a predetermined frequency and an oscillation voltage of the exciting coil is detected. Also, an influence of a reactive magnetic field produced by eddy current induced on a surface of the coin is detected by the receiving coil. Material of the coin can be determined based on the oscillation voltage level of the exciting coil. The degree of the reactive magnetic field differs depending on a difference in surface irregularity of the coin, so that the coin can be discriminated based on the difference in irregularity. The apparatus is simple in construction and thus manufacturable at low cost.

17 Claims, 8 Drawing Sheets

FOREIGN PATENT DOCUMENTS

JP H3-74438 11/1991

JP 11-250305 * 11/1999

* cited by examiner

VERTICAL AXIS: 1(V)/div
HORIZONTAL AXIS: 20(ms)/div

| | U.S. 5-CENT COIN | PANAMA 5-CENTESIMO COIN |
|---|---|---|
| MATERIAL | SINGLE CUPRONICKEL | SINGLE CUPRONICKEL |
| DIAMETER | $\phi$ 21.2mm | $\phi$ 21.2mm |
| THICKNESS | 1.9mm | 1.8mm |

COIN INSPECTION METHOD AND APPARATUS THEREFOR

BACKGROUND OF THE INVENTION

1. Field of the Invention

The present invention relates to a method of and apparatus for inspecting coins, and more particularly to a method of and apparatus for discriminating authenticity of coins, for use in automatic vending machines, game machines, etc.

2. Description of Related Art

An apparatus for inspecting coins, which is prevailing in recent years, is of an electronic type using induction coils.

This type of coin inspection apparatus generally utilizes the falling of coins due to their own weight and is provided with a passage for guiding a coin inserted from a coin slot. Also, a plurality of sets of induction coils are arranged along the passage to produce electromagnetic fields excited by respective different frequencies.

Inspection of coins is performed on the well-known principle. When a coin passes through the electromagnetic field, an amount of electrical change (change in frequency, voltage, or phase) derived due to the interaction between the electromagnetic field and the coin is detected to thereby inspect the authenticity of the coin.

Since in many cases features of coins appear in relation to frequency-dependent parameters, a conventional coin inspection apparatus employs techniques of inspecting materials, diameters, thicknesses, etc. of coins by using electromagnetic fields of a plurality of frequencies, as disclosed in U.S. Pat. No. 3,870,137.

In recent so-called borderless societies in which coins can be easily brought from one country to another, an increasing number of unacceptable coins tend to be used erroneously or deceitfully. Some of the coins used in various countries resemble each other in material, diameter, thickness, etc., and a typical example is 5-cent coin used in the U.S.A. and 5-centesimo coin used in Panama. Such coins differ from each other only in surface design (surface irregularity pattern) and are substantially identical with each other in material, diameter, and thickness. With the conventional arrangement using induction coils, a change in thickness caused by the surface irregularity pattern of coin cannot be detected by simply using a plurality of frequencies, with the result that resembling coins like those mentioned above cannot be discriminated from each other.

Attempts have also conventionally been made to adopt an optical process such as image processing as a means of discriminating resembling coins like those mentioned above. However, the optical apparatus has a problem in that the authenticity determination of coins can be adversely affected by adhesion of dust or the like, and also has a problem in that the apparatus is expensive because of its large size and complicated structure.

SUMMARY OF THE INVENTION

An object of the present invention is to provide a coin inspection method and an apparatus therefor capable of detecting a plurality of different parameters with a simple coil arrangement and discriminating coins of different materials and different surface patterns with high accuracy and low cost.

In the coin inspection method of the present invention, an exciting coil and a receiving coil are arranged in the vicinity of one side of a coin passage so that the exciting coil and the receiving coil are electromagnetically coupled with each other, and the exciting coil is excited to oscillate at such a frequency that an influence of a reactive magnetic field produced by eddy current induced on a surface of a coin thrown into a machine when the coin passes through the electromagnetic field is detected by the receiving coil. Then, the authenticity of the thrown coin is discriminated based on at least one of amplitude, frequency and phase of the oscillation voltage of the exciting coil, and an electromotive force signal detected by the receiving coil.

The excitation frequency is preset in accordance with material of the coin to be inspected. The material of the thrown coin can be determined based on the amplitude of the oscillation voltage of the exciting coil, and a feature of surface irregularity pattern of the thrown coin can be determined based on the electromotive force signal from the receiving coil. Thereby, the coin is inspected by the authenticity discrimination based on the material of the coin and the authenticity discrimination based on the feature of surface irregularity pattern of the coin.

The coin inspection apparatus of the present invention for carrying out the above-described method comprises an exciting coil arranged in the vicinity of one side of a coin passage; a receiving coil arranged in the vicinity of the one side of the coin passage so as to be electromagnetically coupled with the exciting coil; oscillation means for exciting and oscillating the exciting coil at a predetermined frequency to produce an electromagnetic field; first detecting means for detecting at least one of amplitude, frequency and phase of the oscillation voltage of the exciting coil; second detecting means for detecting an electromotive force signal generated in the receiving coil; and discriminating means for discriminating authenticity of the thrown coin based on detection outputs from the first and second detecting means.

Further, the coil arrangement may be such that an exciting coil is arranged in the vicinity of one side of a coin passage inclined at a predetermined angle so that magnetic poles thereof face the coin passage, and two receiving coils having substantially identical characteristics are arranged in the vicinity of the one side of the coin passage so that the receiving coils are electromagnetically coupled with the exciting coil.

DETAILED DESCRIPTION OF THE PREFERRED EMBODIMENTS

Figure 1A:
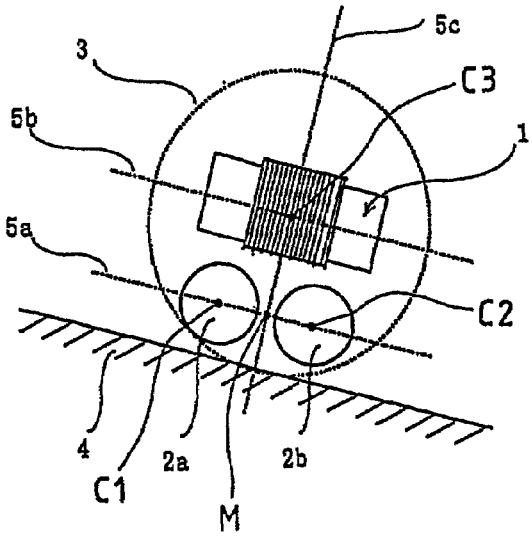
FIGS. 1*a* and 1*b* are a front view and a sectional view, respectively, showing a detection coil arrangement according to an embodiment of the present invention.
Figure 1B:
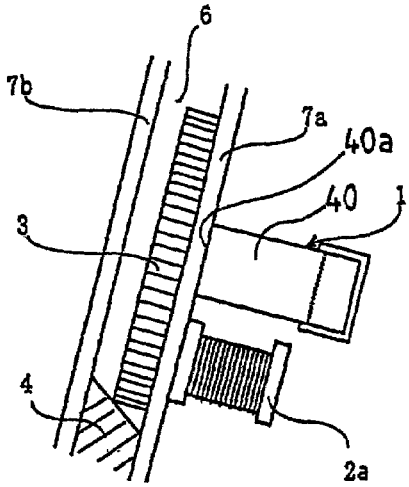
Figure 2:
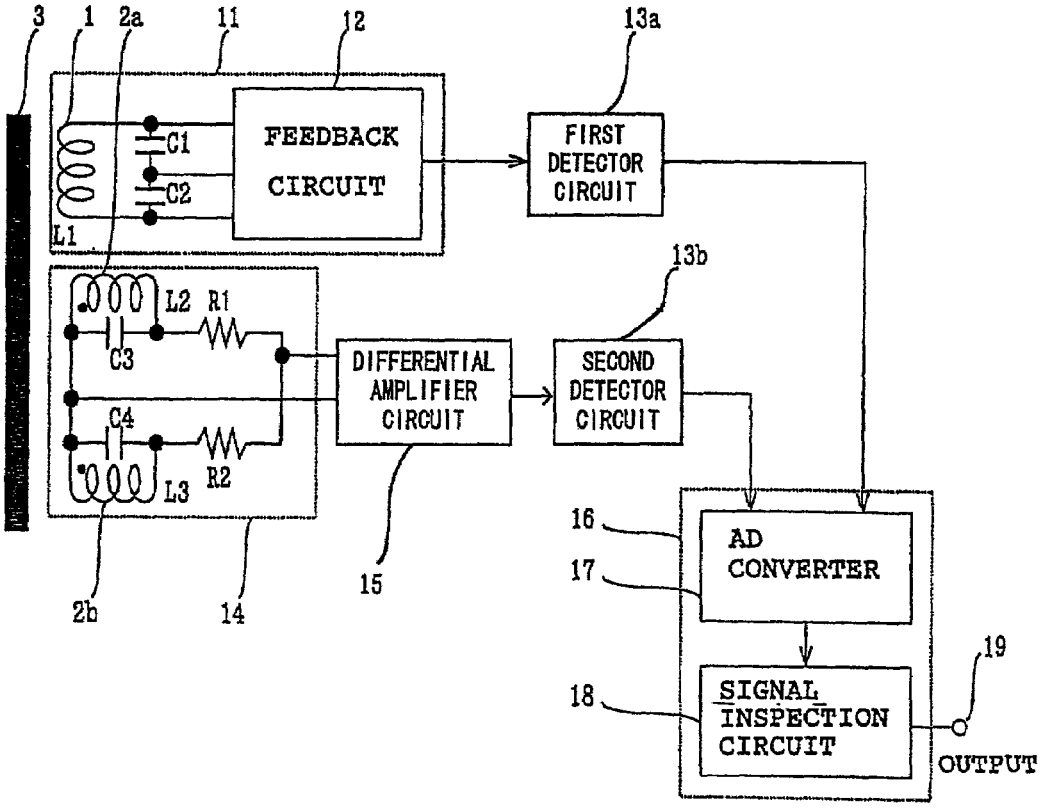
FIG. 2 is a block diagram showing a circuitry arrangement for a coin inspection apparatus according to the embodiment of the present invention.

FIGS. 1*a* and 1*b* show an arrangement of detection coils for detecting a material and a surface irregularity pattern of a coin, and FIG. 2 shows a circuitry arrangement for a coin inspection apparatus.

Referring to FIGS. 1*a* and 1*b*, the detection coils consist of one exciting coil 1 and two receiving coils 2*a* and 2*b*, and are arranged along a passage wall 7*a* on one side of a coin passage 6. The coin passage 6 is sloped at a predetermined angle to allow a coin 3 to roll down while being guided thereby, and comprises a coin rail 4 arranged at the bottom thereof and a pair of passage walls 7*a* and 7*b*. The passage walls 7*a* and 7*b* are, as shown in FIG. 1*b*, inclined with respect to the vertical direction so that the coin 3 may roll down while being inclined toward the passage wall 7*a*. Also, the surface of the coin rail 4, on which the coin is guided, is inclined in the direction in which the passage walls 7*a* and 7*b* are inclined so that the coin 3 passing thereon may be inclined toward the passage wall 7*a*.

Figure 5A:
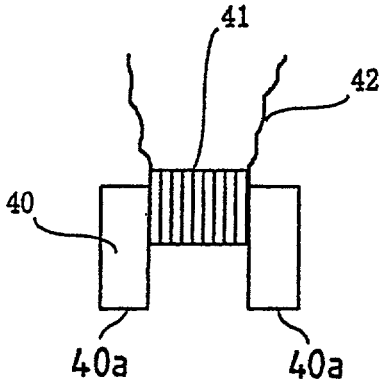
FIG. 5*a* is a front view showing the details of an exciting coil shown in FIGS. 1*a* and 1*b*.
Figure 5B:
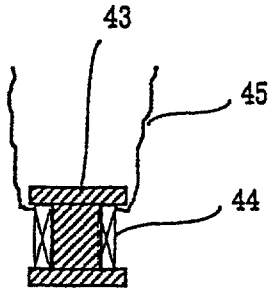
FIG. 5*b* is a sectional view showing the details of a receiving coil.

Each of the two receiving coils 2*a* and 2*b* comprises, as shown in FIG. 5*b*, a drum type core 43 and a winding 44 wound around the core 43. As shown in FIG. 1*a*, the receiving coils 2*a* and 2*b* are arranged above the coin rail 4 at a predetermined distance from each other so that a line 5*a* connecting the centers of the coils 2*a* and 2*b* is substantially parallel with the coin rail 4.

The exciting coil 1 comprises, as shown in FIG. 5*a*, a U-shaped core 40 made of a magnetic material and a winding 41 wound around the core 40. As shown in FIG. 1*a*, the exciting coil 1 is arranged above the receiving coils 2*a* and 2*b* so that the center C3 of the core 40 thereof is located on a line 5*c* which is perpendicular to the line 5*a* connecting the centers C1 and C2 of the receiving coils 2*a* and 2*b* and which passes through the middle point M of the line segment C1C2 and also that a line 5*b* connecting the centers of two pole faces 40*a* thereof is substantially parallel with the coin rail 4. Further, as shown in FIG. 1*b*, the core 40 is arranged so that the pole faces 40*a* thereof are parallel with the face of the coin 3 passing thereby. In FIGS. 5*a* and 3*b*, reference numerals 42 and 45 each denote a lead wire.

The exciting coil 1 and the receiving coils 2*a* and 2*b* arranged as described above are electromagnetically coupled by means of an electromagnetic field produced by excitation of the exciting coil 1.

Referring to FIG. 2, reference numeral 11 denotes an oscillation circuit. The oscillation circuit 11 comprises a resonance circuit made up of an exciting coil 1, a capacitor C1, and a capacitor C2 and a feedback circuit 12 connected to the resonance circuit. The oscillation circuit 11 oscillates at an oscillation frequency based on the resonance frequency of the resonance circuit to produce an oscillation voltage at both ends of the exciting coil 1, by which the exciting coil 1 is excited. Thereby, the exciting coil 1 generates an electromagnetic field around the exciting coil 1. The oscillation circuit 11 outputs the oscillation voltage produced at both ends of the exciting coil 1 to a first detector circuit 13*a*. The first detector circuit 13*a*, which is supplied with the oscillation voltage from the oscillation circuit 11, outputs a direct voltage signal corresponding to the oscillation voltage to an inspection means 16. When the coin 3 is located near the exciting coil 1, an eddy current is generated within the coin, so that a magnetic flux in the exciting coil 1 is hindered by a reactive magnetic field, as described later, produced by the eddy current, leading to a change in the amplitude, frequency and phase of the aforementioned oscillation voltage at both ends of the exciting coil 1. This change differs depending on the material of coin. Thereby, when the coin 3 moves in the vicinity of the exciting coil 1 and is acted upon, the oscillation voltage serves as a signal mainly representing the feature of material of the coin 3. Therefore, by inspecting this signal, the feature of material of coin to be discriminated can be inspected.

In the two receiving coils 2*a* and 2*b* constructed as described above, on the other hand, an electromotive force corresponding to the strength of the electromagnetic field produced by the exciting coil 1 is generated. As described above, the exciting coil 1 and the receiving coils 2*a* and 2*b* are preferably arranged so as to be close to the face of the coin 3 to carry out inspection.

When the coin 3 is acted upon by the electromagnetic field formed as described above, eddy current is induced in the vicinity of the surface of the coin 3 excited by the exciting coil 1, and with an increase in excitation frequency, the eddy current is generated intensely in the vicinity of the outer periphery of the coin due to skin effect.

When the coin 3, which is a conductor, moves in the magnetic field produced by the excitation coil 1, an inductive electromotive force is generated and the eddy current as the induced current flows on the surface of the coin 3. According to Lenz's law, the eddy current as the induced current flows in the direction such that a magnetic field produced by the induction current prevents the change of the magnetic flux produced by the excitation coil 1. In the following description, the magnetic field produced by the induced current is referred to as a "reactive magnetic field".

Thus, the eddy current produces the reactive magnetic field in the vicinity of the outer periphery of the coin and the reactive magnetic field interacts with the receiving coils 2*a* and 2*b* according to a subtle change of the contour feature of the coin surface. In each of the receiving coils 2*a* and 2*b*, produced is an electromotive force corresponding to such a change of the reactive magnetic field indicative of the contour feature of the coin 3. A signal generated by the electromotive force is hereinafter referred to as a "detection signal".

Further, since the magnetic poles of the exciting coil 1 are arranged in the vicinity of the receiving coils 2*a* and 2*b*, a change of the reactive magnetic field produced when the coin 3 acts on the electromagnetic field produced by these magnetic poles can be acquired at a location near the magnetic poles.

The reactive magnetic field produced due to the skin effect is noticeably observed near the outer periphery of the coin, but in cases where coins have large surface irregularity, the region of coins where a change of the reactive magnetic field can be detected is not particularly limited to the outer peripheral region alone. Based on the detection signal of the receiving coils 2*a* and 2*b*, a corresponding alternating voltage signal is generated in a bridge circuit 14 including the receiving coils 2*a* and 2*b*, and is output to an differential amplifier circuit 15. The differential amplifier circuit 15 amplifies the alternating voltage signal generated by the bridge circuit 14, and outputs the amplified signal to a second detector circuit 13*b*. The second detector circuit 13*b*, which is supplied with the alternating voltage signal amplified by the differential amplifier circuit 15, outputs a direct voltage signal corresponding to the detection signal to the inspection means 16. The inspection means 16 supplies the direct voltage signal to an AD converter 17 provided therein, and the AD converter 17 converts the direct voltage signal into a digital signal of a corresponding voltage. The digital signal is output to a signal inspection circuit 18 provided in the inspection means 16. The signal inspection circuit 18 determines whether or not the coin 3 has a given feature, and outputs the result of determination to an output terminal 19. The output of the signal inspection circuit 18 is used to drive a deflector solenoid 35, described later, or a coin counter or the like, not shown.

Figure 3:
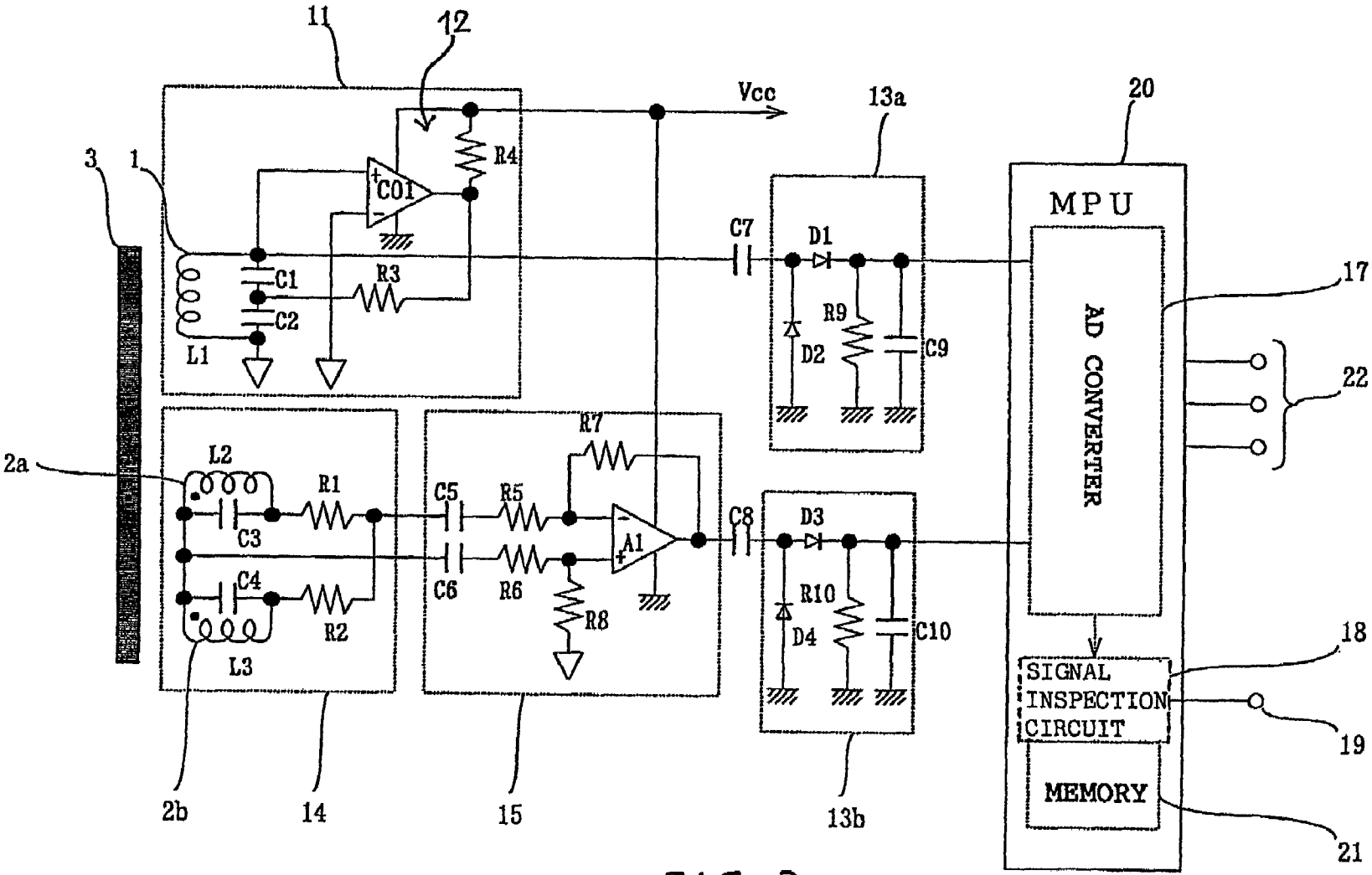
FIG. 3 is a diagram showing details of the circuitry shown in FIG. 2.
Figure 4:
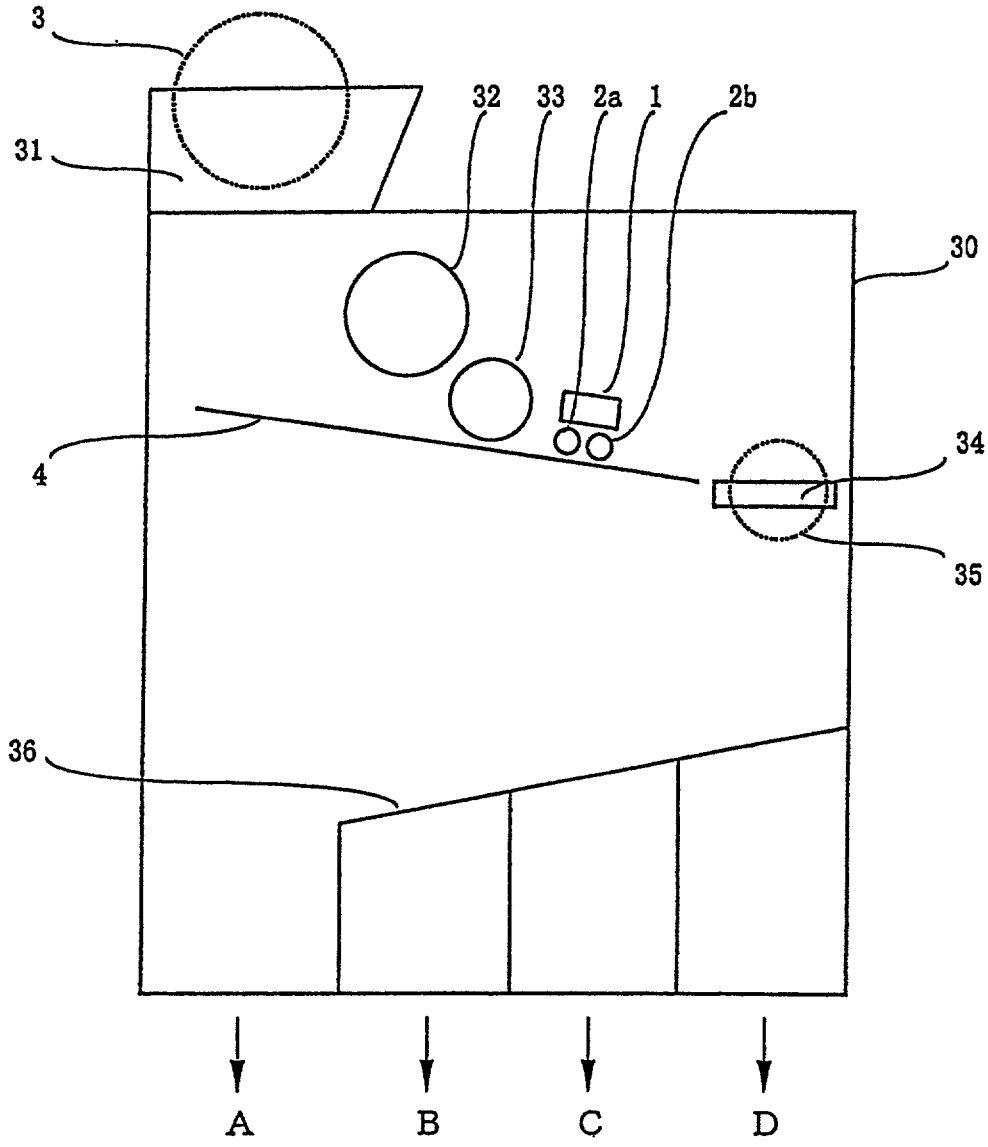
FIG. 4 is a front view showing the outline of the coin inspection apparatus.

FIG. 3 is a diagram specifically showing the details of the block circuits shown in FIG. 2. FIG. 4 shows the coin inspection apparatus, and FIG. 5 shows a coin arrangement.

Referring to FIG. 3, the arrangement of the individual circuits shown in the block diagram of FIG. 2 will be described in detail. The oscillation circuit 11 comprises the resonance circuit constituted by the exciting coil 1, capacitor C1, and capacitor C2 and the feedback circuit 12 constituted by a comparator C01, feedback resistor R3, and resistor R4.

The first detector circuit 13*a* comprises a rectifier circuit (voltage multiplying rectifier circuit) including diodes D1 and D2 connected to a coupling capacitor C7 connected to the output of the oscillation circuit 11, and an integrating circuit including a resistor R9 and a capacitor C9.

The bridge circuit 14 comprises a capacitor C3 connected in parallel with the receiving coil 2*a* (inductance L2), a capacitor C4 connected in parallel with the receiving coil 2*b* (inductance L3), and resistors R1 and R2.

The differential amplifier circuit 15 comprises capacitors C5 and C6 connected to the output of the bridge circuit 14 in an AC coupling fashion, an operational amplifier A1, and resistors R5, R7 and R6, R8 connected so as to determine the gain of the operational amplifier A1.

The second detector circuit 13*b* comprises a rectifier circuit (voltage multiplying rectifier circuit) including diodes D3 and D4 connected to a coupling capacitor C8 connected to the output of the differential amplifier circuit 15, and an integrating circuit including a resistor R10 and a capacitor C10.

The AD converter 17 and the signal inspection circuit 18 of the inspection means 16 are constituted by using an MPU (microprocessor unit).

The oscillation circuit 11 excites the exciting coil 1 with a predetermined frequency. The frequency is preferably one at which the electromagnetic field does not penetrate into the coin, being preferably in the range of 70 kHz to 90 kHz. An experiment according to the present invention was conducted with the frequency set at 90 kHz.

When the coin 3 is located near the exciting coil 1 of the oscillation circuit 11, an eddy current is generated within the coin 3, so that a magnetic flux in the exciting coil 1 is hindered by the reactive magnetic field operation caused by the eddy current, leading to a change in the amplitude, frequency, and phase of the oscillation voltage at both ends of the exciting coil 1. In this embodiment, the change in amplitude is detected. Specifically, the level of the oscillation voltage is detected. The oscillation circuit 11 outputs the oscillation voltage occurring at both ends of the exciting coil 1 to the first detector circuit 13*a*. The first detector circuit 13*a*, which is supplied with the oscillation voltage from the oscillation circuit 11, outputs a direct voltage signal corresponding the oscillation voltage to the inspection means 16.

Figure 6A:
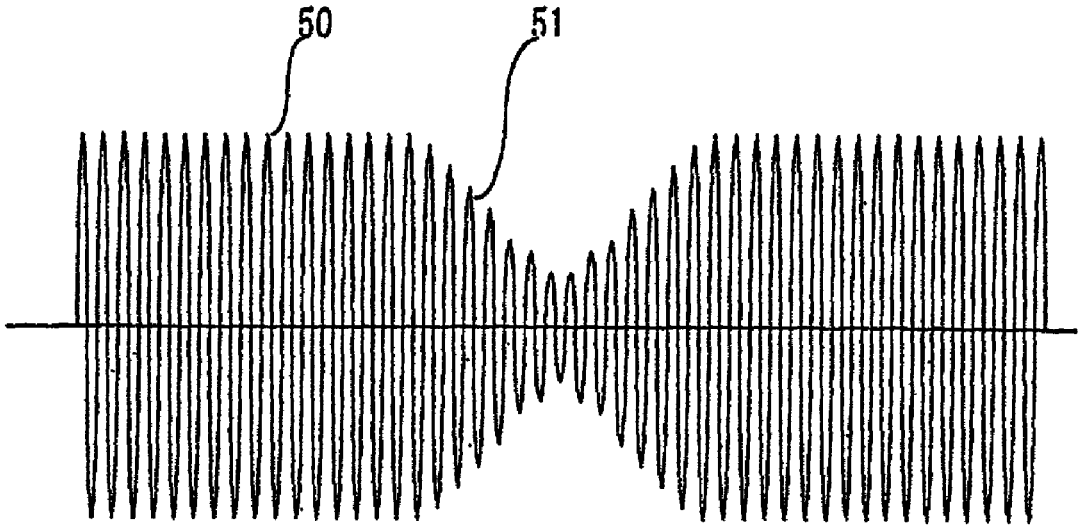
FIG. 6*a* is a graph showing an oscillation voltage waveform detected by the exciting coil.

FIG. 6*a* shows an example of a state of an oscillation voltage 50 output from the oscillation circuit 11. When the coin 3 is not located near the exciting coil 1, the oscillation voltage 50 output from the oscillation circuit 11 has a constant amplitude. However, when the coin 3 passes in the vicinity of the exciting coil 1, the oscillation voltage in a segment in which the coin 3 hinders the magnetic flux in the exciting coil 1 has a decreased amplitude as indicated by reference numeral 51. The magnitude of this decreased amplitude differs depending on the material of the coin 3. Therefore, the material of the coin 3 can be discriminated by the minimum amplitude level.

Figure 6B:
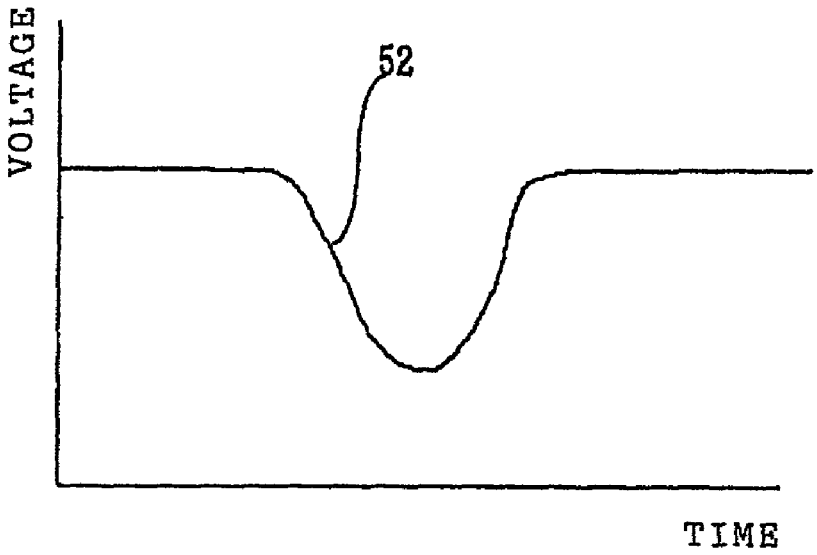
FIG. 6*b* is a graph showing a waveform obtained by rectifying the waveform shown in FIG. 6*a;*

The oscillation voltage output from the oscillation circuit 11 is supplied to the first detector circuit 13*a* and is rectified. It is converted into a DC voltage 52 as shown in FIG. 6*b*, and is supplied to the AD converter 17 of the inspection means 16. The AD converter 17 samples the DC voltage input thereto, and stores the result in a memory 21. As described later, the authenticity etc. of the coin 3 are determined based on the stored sampling data. In this embodiment, judgment is made as to whether or not the minimum level of the stored sampling value falls within a preset reference range, whereby the authenticity of the coin 3 is determined.

The bridge circuit 14 with the above-described arrangement constitutes an AC bridge circuit, and this AC bridge circuit is balanced when the condition $$Z1 \cdot Z4 = Z2 \cdot Z3$$

is fulfilled, where Z1 is the impedance caused by the receiving coil 2*a* and the capacitor C3 connected in parallel with each other, Z2 is the impedance caused by the receiving coil 2*b* and the capacitor C4 connected in parallel with each other, Z3 is the impedance of the resistor R1, and Z4 is the impedance of the resistor R2.

The output of the bridge circuit 13 is a signal appearing between the junction point between the receiving coils 2*a* and 2*b* and the junction point between the resistors R1 and R2, as shown in FIG. 3; therefore, provided the voltage across the receiving coil 2a is V1, the current flowing to the impedance Z1 is i1, the voltage across the receiving coil 2b is V2, and the current flowing to the impedance Z2 is i2, a voltage Vdef of the signal appearing between the above two junction points is given as follows (it is assumed that the impedance Z3 of the resistor R1 is equal to the impedance Z4 of the resistor R2):

$$V1 = Z1 \cdot i1$$

$$V2 = Z2 \cdot i2$$

$$Vdef = V1 - V2$$

$$Vdef = Z1 \cdot i1 - Z2 \cdot i2$$

In this embodiment, the resonance frequency of the LC resonance circuit constituted by the receiving coil 2*a* and the capacitor C3 and the resonance frequency of the LC resonance circuit constituted by the receiving coil 2*b* and the capacitor C4 are set so as to be substantially equal to the oscillation frequency output from the oscillation circuit 11. Accordingly, the impedances Z1 and Z2 are substantially equal to each other, and the signal appearing between the aforementioned two junction points is a voltage signal induced by the difference between the currents i1 and i2.

The differential amplifier circuit 15 with the above-described arrangement amplifies the alternating voltage signal input thereto from the bridge circuit 14 to obtain a desired alternating voltage signal, which is then output to the second detector circuit 13*b*.

The second detector circuit 13*b* with the above-described arrangement, which is supplied with the alternating voltage signal output from the differential amplifier 15, performs detection and rectification of the signal by means of the diodes D3 and D4, and then converts the signal into a direct voltage signal corresponding to the output of the bridge circuit 14 by means of the integrating circuit constituted by the resistor R10 and the capacitor C10.

The AD converter 17 with the above-described arrangement is implemented by an AD converter of successive approximation and conversion type built in the MPU 20 and having a resolution of, for example, 8 bits. The AD converter 17 samples the analog direct voltage signal from the second detector circuit 13*a* at predetermined intervals of time and converts the same into a digital signal corresponding to the output of the bridge circuit 14, the resulting digital signal train being output to the signal inspection circuit 18.

The signal inspection circuit 18 with the above-described arrangement, which is thus supplied with the digital signal train on an amplitude axis from the AD converter 17, temporarily stores the signal train in a memory such as RAM, obtains a statistic based on the digital data temporarily stored in the RAM and data of a corresponding denomination stored beforehand in the memory 21, then compares the obtained statistic with a predetermined value stored in advance in the memory 21 to determine whether or not the coin in question has a given feature, and outputs the result of determination to the output terminal 19.

As a specific method of obtaining the above statistic, the following equation may be used to derive a correlation coefficient:

$$r = \frac{\sum_{i=1}^{N}(Xi - Xa)(Yi - Ya)}{\sqrt{\sum_{i=1}^{N}(Xi - Xa)^2}\sqrt{\sum_{i=1}^{N}(Yi - Ya)^2}} \quad (1)$$

In equation (1) above, N represents the number of samples, variable Xi is a sampling value, that is, a value of the aforementioned digital signal train obtained through measurement of a coin to be detected, and variable Yi is a statistical value obtained through sampling/measurement of coins of acceptable denomination with the use of an apparatus according to this invention. Xa and Ya are average values of the respective variables.

Taking the processing speed of the MPU into consideration, the deviation (Yi−Ya) between the sampling value Yi of acceptable denomination and its average value Ya in the sum of deviation cross products in the numerator of equation (1) and the square root of the sum of squares of the deviation between the sampling value Yi and its average value Ya in the denominator of equation (1) may be calculated in advance and stored in the memory 21, in which case the speed of execution of the subsequent process can be greatly increased.

The absolute value of the correlation coefficient r obtained by equation (1) falls within a range of $0 \leqq |r| \leqq 1$, as is conventionally known, and therefore, whether a coin to be detected has a given feature or not can be determined by comparing the correlation coefficient r with a predetermined value stored beforehand. If the coefficient r is infinitely close to "1", then the coin in question can be judged to be a genuine coin of acceptable denomination. On the other hand, if, as a result of the determination, the coefficient is found to be infinitely close to zero, the coin in question can be judged false.

Figures 7, 8:
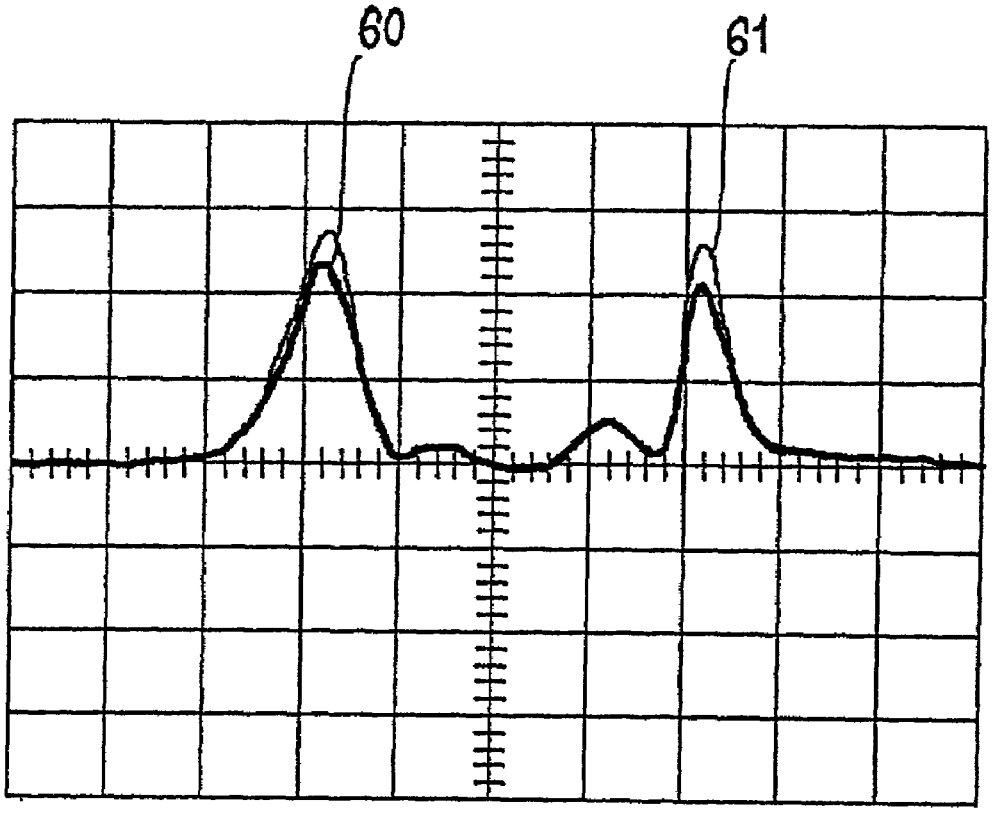
FIG. 7 is a characteristic diagram showing features of irregularity patterns of representative coins.
FIG. 8 is a table showing comparison of data of the representative coins.

Referring now to FIGS. 7 and 8, characteristics of representative coins measured using the apparatus of this invention will be described. FIG. 7 shows the characteristics of the representative coins and FIG. 8 shows comparison of data of the coins. As shown in FIG. 8, 5-cent coin of the U.S.A. and 5-centesimo coin of Panama, as representative coins, are very alike in material (cupronickel), diameter, and thickness. The two coins, when observed visually, are different from each other only in their surface design.

FIG. 7 is a characteristic diagram showing the results of measurement of these coins by means of the apparatus of this invention wherein the exciting coil 1 was excited at an excitation frequency of 90 kHz. In FIG. 7, reference numeral 60 (thick line) represents the characteristic curve of 5-cent coin of the U.S.A., and 61 represents the characteristic curve of 5-centesimo coin of Panama. As shown in FIG. 7, a difference in characteristics between these two coins appears in the first and last peaks. This peak difference arose probably because a reactive magnetic field characterized by the irregularity of surface pattern of the coin was produced by eddy current induced on the coin surface and was detected as a subtle difference in electromotive force generated in the aforementioned two receiving coils. The above difference could not be detected by conventional techniques.

Referring now to FIGS. 4 and 2, the operation of an apparatus 30 for determining authenticity of coins will be described in detail.

In the authenticity determination apparatus 30 for coins shown in FIG. 4, a coin 3 inserted from a coin slot 31 falls naturally due to its own weight onto the coin rail 4 arranged under the coin slot 31. The coin 3 thus dropped on the coin rail 4 rolls down through the coin passage 6 (FIG. 1*b*) in a downstream direction away from the coin slot 31. While moving through the coin passage 6, the coin 3 passes by a diameter detection coil 32 and a material/irregularity detection coil including the exciting coil 1 and the receiving coils 2*a* and 2*b*. The apparatus 30 determines the authenticity of the coin 3 while the coin 3 passes by the individual detection coils. If, as a result of the determination, the coin 3 is judged to be genuine, a deflector solenoid 34 is driven in accordance with the signal output to the output terminal 19, to actuate a gate 33 so that the coin 3 is guided to a genuine-coin passage, not shown. On the other hand, if as a result of the determination the coin 3 is judged to be a false coin, the gate 33 is not actuated, so that the coin 3 is guided to a false-coin passage, not shown, to be let out from an outlet, not shown.

When the coin 3 is genuine and thus introduced to the genuine-coin passage, it continues to fall naturally and drops onto a coin rail 35. The coin 3 which has dropped onto the coin rail 35 is then sorted by conventionally known sorting means, not shown, according to denomination, and let out from a corresponding one of outlets A, B, C and D provided for respective denominations.

For the diameter detection coil 32 mentioned above, conventional inspection techniques may be used.

Figure 9:
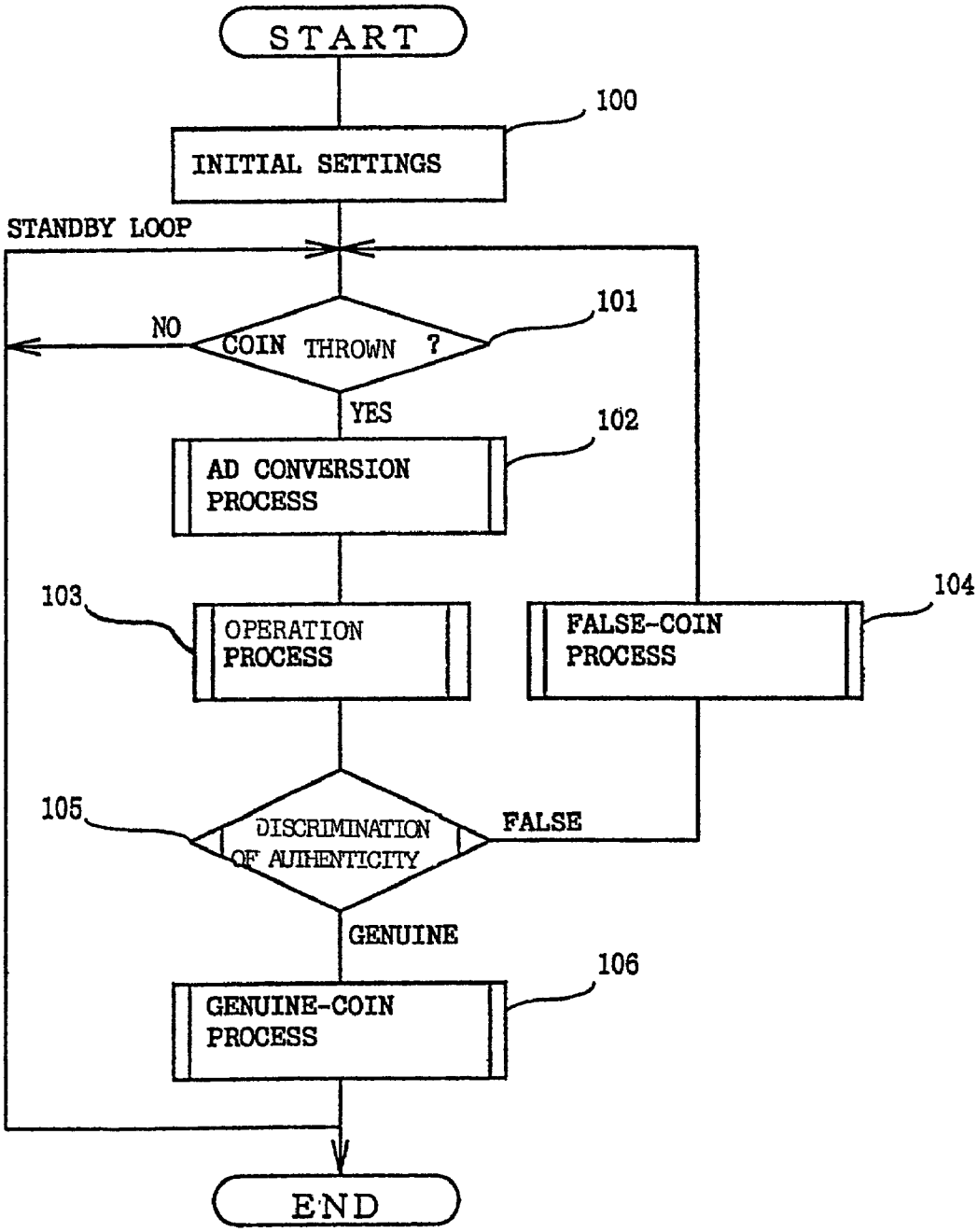
FIG. 9 is a flowchart of inspection processing to be performed by an MPU of a control unit.

Referring now to the flowchart of FIG. 9, the operation of the apparatus 30 for determining the authenticity of coins will be described in detail. In FIG. 9, when the power supply to the apparatus is switched on, initial settings such as input/output settings in the MPU 20 are carried out in Step 100. After execution of Step 100, a process for determining whether or not a coin has been thrown into the apparatus is executed in Step 101 by using the signal from the detection coil. If it is judged in Step 101 that a coin has been thrown in, the program proceeds to an AD conversion process in Step 102. On the other hand, if it is judged in Step 101 that a coin has not been thrown in yet, a standby process is repeated until arrival of a coin.

When it is judged in Step 101 that a coin has been thrown in, the AD conversion process is executed in Step 102, as mentioned above. On reception of the signal indicative of arrival of a coin at the detection coil, the AD conversion process of Step 102 starts sampling for each detection coil. The result of sampling is temporarily stored in the memory such as RAM in the MPU 20 and the program proceeds to a computation process in Step 103. The process for determining the authenticity of coin by means of the diameter detection coil 32 is the same as that of the conventional method, and therefore, the description thereof is omitted.

In Step 103, a computation process is carried out for the digital data temporarily stored in the memory 21 to obtain data for determining the authenticity of coin. First, a minimum value is determined from the data obtained by sampling the DC voltage output from the first detector circuit 13*a*, and is stored in the memory. Further, from the data obtained by sampling the DC voltage output from the second detector circuit 13*b* and the statistic of the acceptable coin stored beforehand in the memory 21, the computation in the aforementioned equation (1) is performed to obtain a correlation coefficient r, and the obtained correlation coefficient r is stored.

In the authenticity determination process of Step 105, it is judged whether or not the minimum value of output of the first detector circuit 13*a* determined by the computation process in Step 103 falls within a preset reference range. If the value falls within the reference range, it is judged that the material is identical with that of the acceptable coin, and if the value does not fall within the reference range, it is judged that the material is different from that of the acceptable coin. Thus, the material of coin is determined. Also, the correlation coefficient r obtained by the computation process of Step 103 is compared with the predetermined value of acceptable coin stored in advance, whereby the irregularity pattern of the coin 3 is determined.

If the material of coin in question is judged to be identical with that of the acceptable coin, and if the relationship, correlation coefficient r>predetermined value, is fulfilled, the coin in question is judged to be genuine, and the program proceeds to a genuine-coin process in Step 106. On the other hand, if the material of coin in question is judged to be different from that of the acceptable coin, or if it is judged that the relationship, correlation coefficient r<predetermined value, is fulfilled, the coin in question is judged to be false; in which case the program executes a false-coin process in Step 104 and returns to the standby loop.

An alternative method may be used in which the authenticity determination process based on the material of coin is first carried out, and if the material of coin in question is judged to be different from that of the acceptable coin, the computation process for determining a correlation coefficient r for determining the irregularity pattern and the authenticity determination process by means of the correlation coefficient r are not carried out. Specifically, a minimum value is determined from the data obtained by sampling the DC voltage output from the first detector circuit 13*a*, and it is judged whether or not the minimum value falls within a preset reference range, to determine the material of the coin 3. If the value does not fall within the reference range, it is judged that the material of the coin 3 is different from that of the acceptable coin, the program proceeds to Step 104 without executing the computation process and judgment for determining the irregularity pattern of the coin 3 and without carrying out the authenticity determination. In Step 104, the false-coin process is executed. Only when the minimum value of sampling data falls within the reference range, and the material of coin in question is judged to be identical with that of the acceptable coin, a correlation coefficient r is obtained to determine the irregularity pattern of the coin 3.

When the coin in question is judged to be genuine in the authenticity determination process of Step 105, the genuine-coin process is executed in Step 106. In the genuine-coin process of Step 106, a process of outputting a genuine-coin signal, a denomination signal, etc. is executed in accordance with the result of authenticity determination, whereupon the program returns to the standby loop.

Although the exciting coil 1 using a ⊐-shaped core is shown in the above-described embodiment, another shape such as a U shape may be used appropriately without departing from the spirit and scope of the present invention.

The arrangement of the exciting coil 1 and the receiving coils 2*a* and 2*b* of the detection coil for detecting the material and irregularity of coin is not limited to that of the above-described embodiment, and the arrangement may be changed according to the shape, surface pattern, etc. of the coin to be discriminated.

Figure 10A:
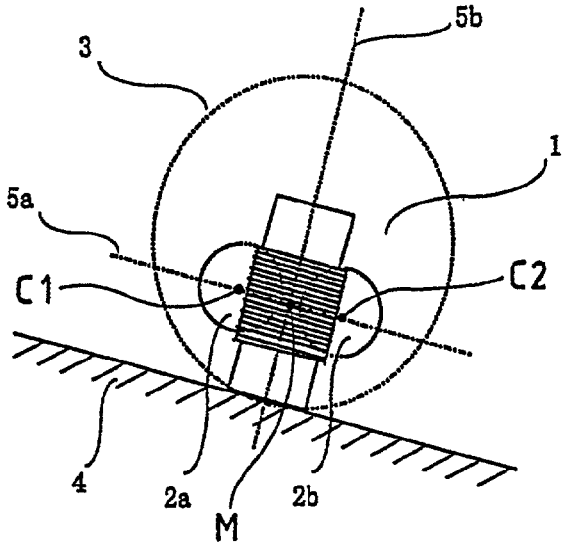
FIGS. 10*a* and 10*b* are a front view and a sectional view, respectively, showing another detection coil arrangement.
Figure 10B:
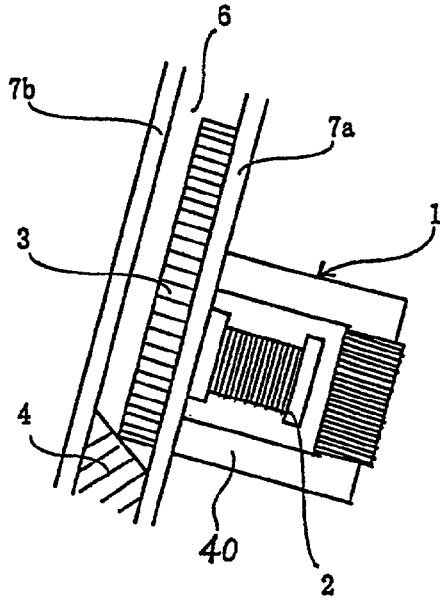

As shown in FIGS. 10*a* and 10*b*, the exciting coil 1 and the receiving coils 2*a* and 2*b* may be arranged so that the line 5*b* connecting the centers of the pole faces 40*a* at the longitudinally opposite end portions of the ⊐-shaped core 40 of the exciting coil 1 is perpendicular to the line 5*a* connecting the centers of the receiving coils 2*a* and 2*b* and passes through the middle point M between the centers C1 and C2 of the receiving coils 2*a* and 2*b*. The operation and effects of this arrangement are identical with those of the above-described embodiment, and therefore, the description thereof is omitted.

Figure 11A:
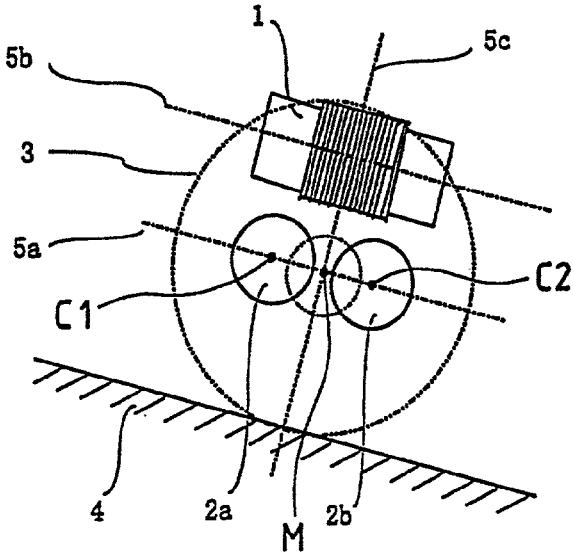
FIGS. 11*a* and 11*b* are a front view and a sectional view, respectively, showing still another detection coil arrangement.
Figure 11B:
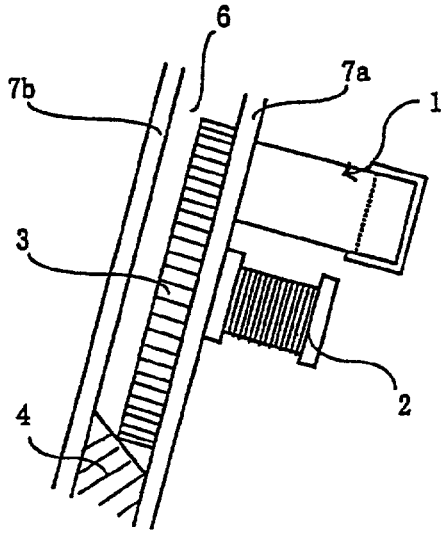

As shown in FIGS. 11*a* and 11*b*, the line 5*a* connecting the centers of the receiving coils 2*a* and 2*b* may be shifted in the vertical direction with respect to the coin rail 4 on which the coin 3 rolls down, so as to pass through the central position of the coin 3 to be detected. In this case, the receiving coils 2*a* and 2*b* are arranged at a location corresponding to the central position of the coin 3 to be detected, and accordingly, the detection value varies in accordance with a difference in surface irregularity pattern of the central portion of the coin 3, so that the arrangement is suited for judging the authenticity of coins by determining whether or not the coin has a hole in the center thereof.

Figure 12A:
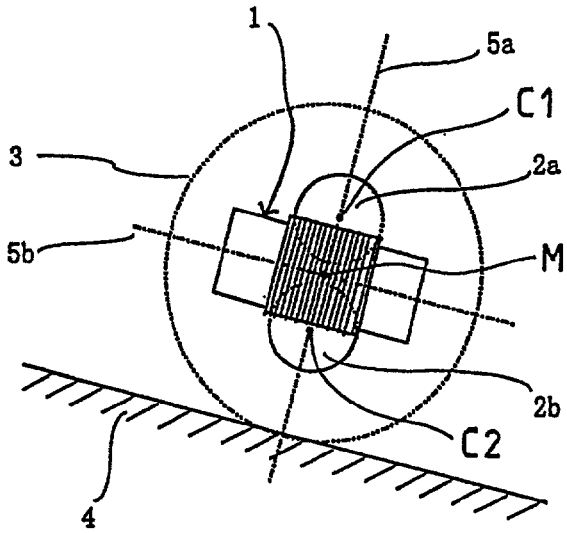
FIGS. 12*a* and 12*b* are a front view and a sectional view, respectively, showing still another detection coil arrangement.
Figure 12B:
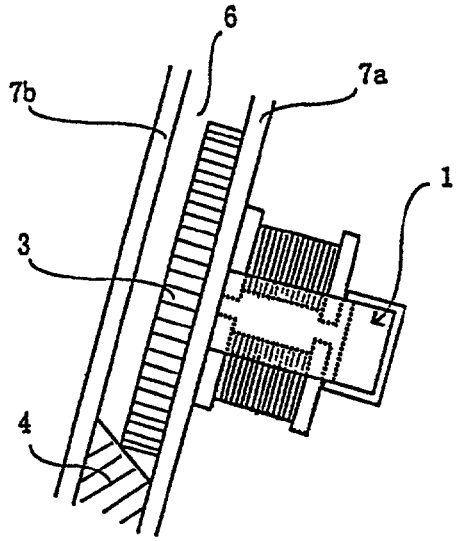

Further, as shown in FIGS. 12*a* and 12*b*, the side-by-side arrangement of the receiving coils may be rotated by 90 degrees so that the line 5*a* connecting the centers of the receiving coils 2*a* and 2*b* may be perpendicular to the line 5*b* connecting the centers of the pole faces of the core of the exciting coil 1 and pass through the center of the exciting coil 1. Also in this case, the receiving coils 2*a* and 2*b* are arranged at a location corresponding to the central position of the coin to be detected, and therefore, this arrangement is suited for judging authenticity of coins by discriminating between presence and absence of change in the surface irregularity pattern of the central portion thereof.

As described above, the position where the receiving coils 2*a* and 2*b* are arranged (the position where the exciting coil is arranged in relation to the position of the receiving coils) may be changed in accordance with a difference in surface irregularity pattern of coins whose authenticity is to be determined (depending on whether the difference in surface irregularity pattern exists in the central portion, e.g. presence/absence of a hole, or in the peripheral portion of the coin).

Figure 13:
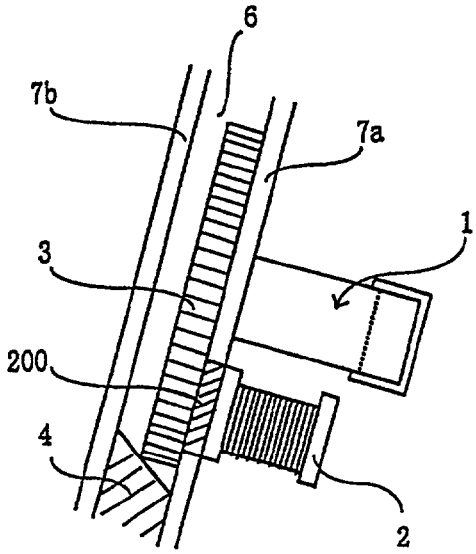
FIG. 13 is a schematic view for showing a structure in which a material of high magnetic permeability is used for a portion of a coin passage wall at which receiving coils are arranged.

Also, according to the present invention, the exciting coil 1 is excited at a frequency such that the electromagnetic field produced penetrates only into the surface region of the coin but not up to the central region of the same, and the influence of a reactive magnetic field caused by eddy current induced in the vicinity of the surface of the coin is measured. Accordingly, the surfaces of the receiving coils 2*a* and 2*b* facing the coin should desirably be as close to the coin surface as possible. As shown in FIG. 13, therefore, a portion of the passage wall 7*a* where the receiving coils 2*a* and 2*b* are arranged, that is, a portion of the passage wall 7*a* extending along the line 5*a* connecting the centers of the receiving coils 2*a* and 2*b* as shown in FIG. 1*a*, may be made of a material 200 having high magnetic permeability, so that the receiving coils 2*a* and 2*b* may be virtually located closer to the surface of the coin.

According to the present invention, since the material and surface irregularity pattern of coin can be detected by the use of a set of simple coils, it is possible to provide at a low cost a small-sized, high-performance coin inspection apparatus capable of dealing with a diversity of coins.

What is claimed is:

1. A method of inspecting a coin thrown into a machine, comprising the steps of:

(a) arranging an exciting coil in the vicinity of one side of a coin passage inclined at a predetermined angle so that magnetic poles thereof face the coin passage;

(b) arranging two receiving coils having substantially identical characteristics in the vicinity of said one side of said claim passage to be electromagnetically connected with said exciting coil and electrically connected to a differential amplifier so that the differential amplifier receives a differential input from said receiving coils;

(c) exciting said exciting coil to oscillate at such a frequency that said two receiving coils detect an influence of a reactive magnetic field caused by eddy current induced on a surface of the thrown coin when the coin passes through an electromagnetic field produced by said exciting coil and issue electromotive force signals representing the influence of said reactive magnetic field as the differential input to said differential amplifier to determine a surface pattern of the thrown coin; and (d) discriminating authenticity of the thrown coin based on a combination of an output of said differential amplifiers and at least one of amplitude, frequency and phase of an oscillation voltage of said exciting coil.

2. A method of inspecting a coin according to claim 1, wherein said frequency in said step (c) is preset in accordance with material of the coin to be inspected.

3. A method of inspecting a coin according to claim 1, wherein said step (d) includes a step of determining material of the thrown coin based on the amplitude of the oscillation voltage of said exciting coil.

4. A method of inspecting a coin according to claim 1, wherein said step (d) includes the steps of sampling said electromotive force signal in a time period, and performing a statistical process based on the sampled values to determine a feature of the thrown coin.

5. A method of inspecting a coin according to claim 4, wherein said statistical process includes the steps of obtaining a coefficient of correlation of said sampled values with respect to a reference coin, and discriminating the thrown coin based on magnitude of said correlation coefficient.

6. An apparatus for inspecting a coin thrown into a machine, comprising:

an exciting coil arranged in the vicinity of one side of a coin passage inclined at a predetermined angle so that magnetic poles thereof face the coin passage;

two receiving coils having substantially identical characteristics arranged in the vicinity of said one side of said coin passage to be electromagnetically coupled with said exciting coil and electrically connected to a differential amplifier so that the differential amplifier receives a differential input from said two receiving coils;

oscillation means for exciting and oscillating said exciting coil to produce an electromagnetic field at such a frequency that an electromotive force influenced by a reactive magnetic filed caused by eddy current induced on a surface of the thrown coin when the coin passes through the electromagnetic field is produced in said receiving coils and said receiving coils issue electromotive force signals representing the electromotive force as the differential input to said differential amplifier;

first detecting means for detecting at least one of amplitude, frequency and phase of an oscillation voltage of said exciting coil;

second detecting means including said differential amplifier to determine a surface pattern of the thrown coin based on the differential input to said differential amplifier; and discriminating means for discriminating authenticity of the thrown coin based on a combination of an output of said first detecting means and an output of said second detecting means.

7. An apparatus for inspecting a coin according to claim 6, wherein said first detecting means includes a first detector circuit for outputting a direct voltage signal corresponding to the oscillation voltage of said exciting coil.

8. An apparatus for inspecting a coin according to claim 6, wherein said second detecting means comprises a bridge circuit including said two receiving coils, a differential amplifier circuit for amplifying an alternating voltage signal outputted from said bridge circuit and outputting the amplified signal, and a second detector circuit for detecting and rectifying the alternating voltage signal from said differential amplifier circuit and converting the same into a direct voltage signal corresponding to the output of said bridge circuit.

9. An apparatus for inspecting a coin according to claim 6, wherein said predetermined frequency is set in accordance with material of the coin to be inspected.

10. An apparatus for inspecting a coin according to claim 6, wherein said discriminating means discriminates material of the thrown coin based on the amplitude of the oscillation voltage of said exciting coil.

11. An apparatus for inspecting a coin according to claim 6, wherein said exciting coil is arranged at a predetermined distance from said receiving coils so that a line connecting centers of magnetic poles of said exciting coil is substantially parallel with an extending direction of said coin passage, and said two receiving coils are arranged above a coin rail provided with said coin passage so that a line connecting centers of said two receiving coils is substantially parallel with an extending direction of said coin passage.

12. An apparatus for inspecting a coin according to claim 6, wherein said exciting coil is arranged at a predetermined distance from said receiving coils so that a line connecting centers of magnetic poles of said exciting coil is substantially perpendicular to an extending direction of said coin passage, and said two receiving coils are arranged above a coin rail provided with said coin passage so that a line connecting centers of said two receiving coils is substantially parallel with an extending direction of said coin passage.

13. An apparatus for inspecting a coin according to claim 6, wherein said exciting coil is arranged at a predetermined distance from said receiving coils so that a line connecting centers of magnetic poles of said exciting coil is substantially parallel with an extending direction of said coin passage, and said two receiving coils are arranged above a coin rail provided with said coin passage so that a line connecting centers of said two receiving coils is substantially perpendicular to an extending direction of said coin passage.

14. An appamtus for inspecting a coin according to claim 6, wherein said coin passage is formed so that a coin passing therethrough is inclined to said one side of said coin passage where said exciting coil and said receiving coils are arranged.

15. An apparatus for inspecting a coin according to claim 6, wherein said discriminating means samples said electromotive force signal in a time period, and performs a statistical process based on the sampled values to determine a feature of the thrown coin.

16. An apparatus for inspecting a coin according to claim 11, wherein said statistical process is performed by obtaining a coefficient of correlation of said sampled values withh respect to a reference coin, and discriminating the coin based on magnitude of said correlation coefficient.

17. An apparatus for inspecting a coin thrown into a machine, comprising:

an exciting coil arranged in the vicinity of one side of a coin passage inclined at a predetermined angle so that two magnetic poles thereof face the coin passage;

two receiving coils having substantially identical characteristics and arranged separately from said exciting coil in the vicinity of said one side of said coin passage so that said receiving coils are electromagnetically coupled with said exciting coil;

oscillation circuit means arranged with said exciting coil as an oscillation element;

first detector circuit means coupled to said oscillation circuit means for detecting at least one of amplitude, phase and frequency of an oscillation voltage in said exciting coil;

bridge circuit means arranged to include said receiving coil;

differential amplifier means connected to said bridge circuit means;

second detector circuit means for detecting an electromotive force signal influenced by a reactive magnetic field caused by eddy currents induced on a surface of the thrown coin an output of said second detector circuit means being connected to said differential amplifier means; and discriminating means connected to said first and second detector circuit means to discriminate a feature of said thrown coin based upon a combination of an output of said second detector circuit means to determine a surface pattern of the thrown coin and an output of said first detector circuit means to determine at least one of amplitude, phase and frequency of said oscillation voltage, and output a result of the discrimination.

* * * * *